US006604301B1

(12) United States Patent
Manoli, II et al.

(10) Patent No.: US 6,604,301 B1
(45) Date of Patent: Aug. 12, 2003

(54) SHOE SOLE INSERT

(75) Inventors: Arthur Manoli, II, 37 Pine Gate Dr., Bloomfield Hills, MI (US) 48304; Brian Graham, 341 Elizabeth Lake Rd., Pontiac, MI (US) 48341

(73) Assignees: Arthur Manoli, II, Bloomfield Hills, MI (US); Brian Graham, Pontiac, MI (US); part interest ( * ) Notice: Subject to any disclaimer, the term of this patent is extended or adjusted under 35 U.S.C. 154(b) by 0 days.

(21) Appl. No.: 09/612,798

(22) Filed: Jul. 10, 2000

(51) Int. Cl.[7] ..... A43B 13/38

(52) U.S. Cl. ..... 36/43; 36/144; 36/91; 36/88

(58) Field of Search ..... 36/43, 44, 95, 36/91, 88, 142, 143, 144, 173, 174, 180

(56) References Cited

U.S. PATENT DOCUMENTS

| | | | | | |
|---|---|---|---|---|---|
| 975,576 | A | * | 11/1910 | Sexton | 36/43 |
| 1,958,097 | A | * | 5/1934 | Shaw | |
| 1,960,418 | A | * | 5/1934 | Schaller | |
| 2,008,207 | A | * | 7/1935 | Greenberg | |
| 2,616,190 | A | * | 11/1952 | Darby | 36/144 |
| 2,726,413 | A | | 12/1955 | Williams | 12/102 |
| 4,124,946 | A | * | 11/1978 | Tomlin | 36/43 |
| 4,317,293 | A | * | 3/1982 | Sigle et al. | 36/43 |
| 4,619,056 | A | | 10/1986 | Lin et al. | 36/43 |
| 4,642,911 | A | * | 2/1987 | Talarico, II | 36/144 |
| 4,685,227 | A | * | 8/1987 | Simmons | 36/144 |
| 4,686,994 | A | | 8/1987 | Harr et al. | 128/586 |
| 4,813,157 | A | | 3/1989 | Boisvert et al. | 36/44 |
| 4,869,001 | A | | 9/1989 | Brown | 36/115 |
| 4,979,318 | A | * | 12/1990 | Cohen | 36/43 |
| 5,282,326 | A | | 2/1994 | Schroer, Jr. et al. | 36/44 |
| 5,327,663 | A | | 7/1994 | Pryce | 36/144 |
| 5,345,701 | A | * | 9/1994 | Smith | 36/144 |
| 5,388,351 | A | | 2/1995 | Mitchell et al. | 36/145 |
| 5,400,528 | A | | 3/1995 | Skinner et al. | 36/161 |
| 5,542,196 | A | * | 8/1996 | Kantro | 36/174 |
| 5,842,294 | A | * | 12/1998 | Fabricant | 36/127 |
| 6,105,283 | A | * | 8/2000 | Park | 36/43 |
| 6,131,311 | A | * | 10/2000 | Brown et al. | 36/43 |

OTHER PUBLICATIONS

Orthopedic Clinics of North America, vol. 20, No. 4, Oct. 1989, pp. 751–757.

* cited by examiner

*Primary Examiner*—M. D. Patterson
(74) *Attorney, Agent, or Firm*—Young & Basile, P.C.

(57) ABSTRACT

A removable orthotic shoe sole insert for a patient having a high arch comprises a built-up heel portion with a deep cup shape with a flaring around the heel pad area for containing the fatty fibrous heel pad, a arch area formed lower than the arch of the wearer and a forefoot portion just lateral to the first metatarsal head and lateral sesamoid of the foot and extending to the lateral edge of the insert. A shallow divot or depression is formed for receiving the first metatarsal and its underlying hallux sesamoids. The shoe sole insert is designed to accommodate the majority of foot sizes and is sized by the length from the posterior heel to the first metatarsal head of the foot so that the first metatarsal head is positioned in the shallow divot of the insert.

17 Claims, 3 Drawing Sheets

SHOE SOLE INSERT

FIELD OF THE INVENTION

The invention relates to an orthotic shoe sole insert and in particular an insert for correction of the human foot disorder, generally known as cavovarus foot.

BACKGROUND OF THE INVENTION

Although many orthotic devices are provided for insertion into the shoe, the vast majority of these inserts are custom made or manufactured to correct the human flat foot. The typical orthotic insert does not alleviate the human foot disorder, generally known as a cavovarus foot. In this disorder, the foot assumes a posture of an inward tipping of the heel (heel supination or varus), and a related forefoot pronation (forefoot valgus). Further with this foot disorder the first metatarsal is plantarflexed and the arch is excessively high (cavus). This disorder results in the chronic inversion sprains of the ankle and subtalar joint, which can result in surgical reconstruction. The disorder may also cause a common stress fracture to the fifth metatarsal as well as stress fractures to the other metatarsals. Other injuries that can result from a cavovarus foot include recurrent dislocation or subluxation of the peroneal tendons, peroneal tendonitis, peroneal tendon splitting, overload callous under the base or head of the fifth metatarsal, metatarsalgia, hallux sesamoiditis, excessive external rotation of the talus and tibia resulting in varus strain of the knee joint, compressive medial compartmental knee overload and arthritis, and increased lateral collateral knee ligaments and iliotibial tract strain and tendonitis. A painful plantar fasciitis may also occur and with longstanding cavovarus foot deformities. A very painful varus ankle arthritis may develop, necessitating ankle arthrodesis (fusion), or total ankle arthroplasty (replacement). Other stress related disorders may occur to the ankle, knee, hip, and spine.

Most orthotic shoe inserts address the human foot disorder known as "flat foot." With this disorder the arch of the foot is collapsed into a lowered position. The flat foot inserts are generally designed to push upwardly on the naviculo-cuneiform area and to support the collapsed medial longitudinal and transverse arches, or by placing additional material in the area between the dorisiflexed metatarsal and the shoe, forming a medial forefoot wedge. Other designs for orthotic inserts either simply conform to the bottom of the foot with metatarsal pads placed proximal to certain metatarsal heads to relieve the force on these areas, or the inserts have hollowed out portions under areas of pressure in the plantar surface of the foot.

SUMMARY OF THE INVENTION

The invention addresses the aforementioned concerns by providing a removable insert for a shoe directed to patients with high arches. In one aspect of the invention, a full length orthotic shoe sole insert is provided for overlying the sole of a shoe of a patient having a high arch and adapted for aligning the foot during movement by providing a small built up heel base portion in the insert, with a midfoot portion of having an arched area lower than the arch of the patient, and a forefoot portion, wherein the forefoot portion has a built-up portion beginning lateral to the head of the first metatarsal and lateral sesamoid of the foot.

In another aspect the build up portion of the forefoot portion of the insert has a constant thickness beginning just lateral to the first metatarsal head and lateral sesamoid.

The shoe sole insert may also include a valgus wedge starting in the transverse arched region of the foot. The valgus wedge may thicken laterally beginning proximal to the lateral first metatarsal head and increase in elevation distally from the heel portion. Further, the insert may have a depression for receiving the first metatarsal head of the foot.

In a further aspect of the invention the insert is sized to the patient by measuring from the posterior heel of the foot to the first metatarsal head, rather than from the heel to the end of the toes.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to, the accompanying drawings wherein like reference numerals refer to like parts throughout the several views, and wherein.

DETAILED DESCRIPTION OF THE PREFERRED EMBODIMENT

Figure 1:
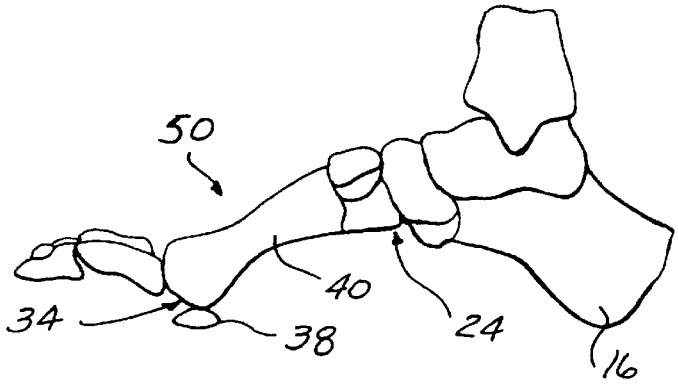
FIG. 1 is a side elevational view of a skeletal foot.
Figure 2:
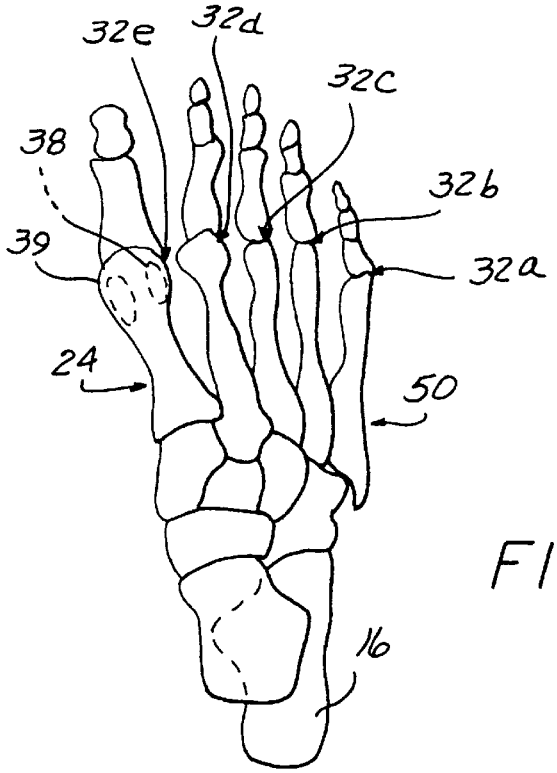
FIG. 2 is a top view of the skeletal foot of FIG. 1.
Figure 3:
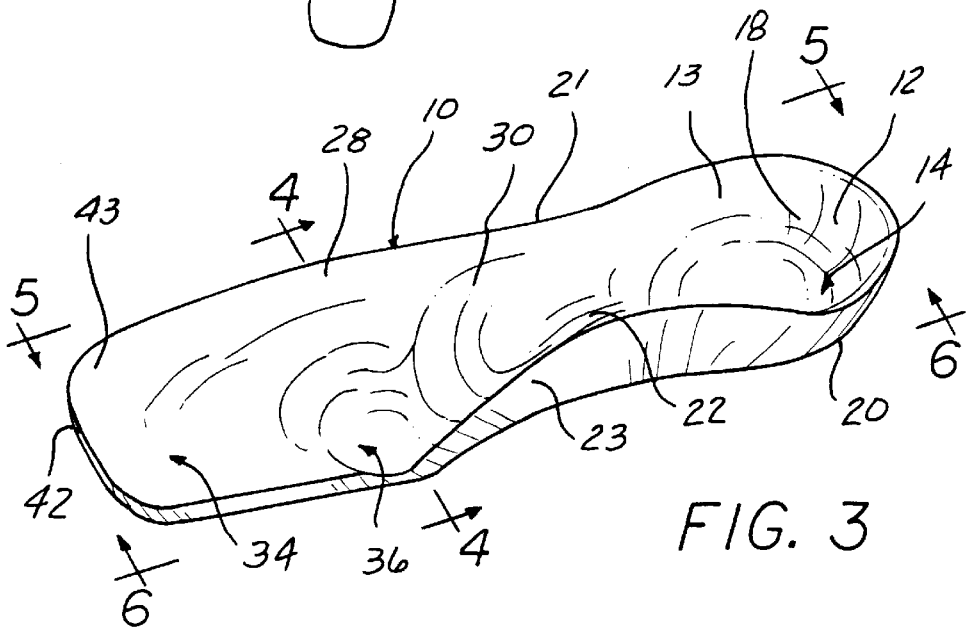
FIG. 3 is a prospective view of the full length orthotic shoe sole insert according to the present invention.

Referring to the drawings and especially FIGS. 1 through 6, the invention provides a removable insert 10, worn in a shoe and which is designed to align the foot during activity of a person suffering from cavovarus foot, wherein the arch is excessively high. FIGS. 1 and 2 are skeletal views of a foot 50 and will be used in reference with explanations regarding the insert shown in FIGS. 3 through 6.

The heel portion 12 of the insert has a deep cup shaped portion 14. The cup shaped portion 14 of the heel portion 12 controls rear foot motion by supporting the calcaneus 16 of the foot by allowing it to sink and rest within the cup shaped portion of the insert 10. This configuration also cushions the heel by containing the fat pad of the heel, which has a tendency to migrate away from the bottom of the heel of a foot having a high arch, generally referred to as a cavus foot. The fat pad of the heel further has the tendency to deform circumferentially as the plantar surface is compressed as the heel strikes the ground. Therefore, around the deep cup shaped heel portion 14 there is a flaring portion 18 to contain the fatty and fibrous heel pad to provide increased resistance to vertical compression of the heel pad using the hydrostatic mechanism and improve heel pad shock absorption. The base 20 of the heel portion 12 has a slight elevation. The elevation together with the addition of the shock absorbing material used in the manufacture of the insert provides increased shock control at the heel strike. This feature also provides heel elevation to compensate for a tight Achilles tendon complex and the equinus that often is present in the cavus foot. As an alternative, the heel portion may have a lateral heel wedge 13 formed therein to increase the valgus positioning of the heel.

The medial arch portion 22 of the shoe insert 10 will have a less prominent or lowered surface than the increased elevation of the medial arch that is generally designed for a person having a flat foot. This lowered medial arch portion surface will allow the cavus arch 24 to pronate and not be limited by coming in contract with the medial arch surface 22. This design feature will also keep the most prominent portion of the arch 24 from inducing a traction force on the plantar fascia.

Figure 4A:
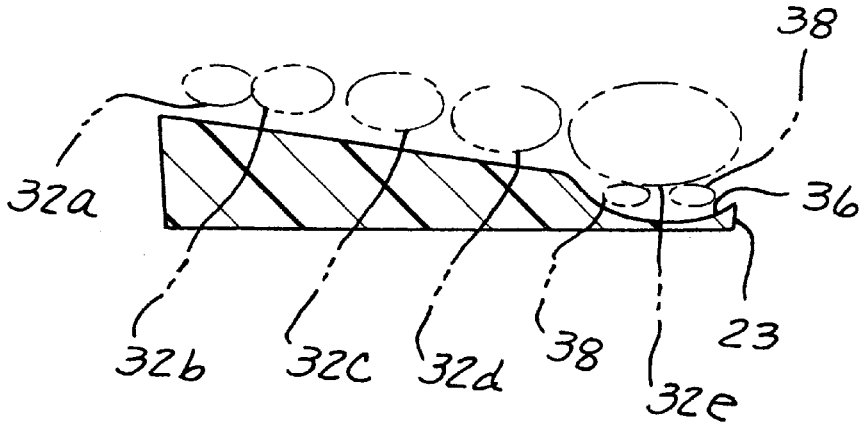
FIG. 4A is a sectional view of one embodiment of the orthotic shoe sole insert taken along lines 4—4 of FIG. 3.
Figure 5:
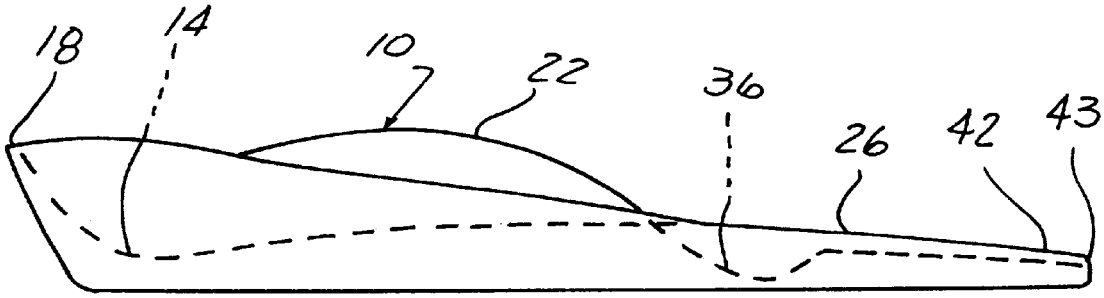
FIG. 5 is a lateral side elevational view of the orthotic shoe sole insert taken along lines 5—5 of FIG. 3.
Figure 4B:
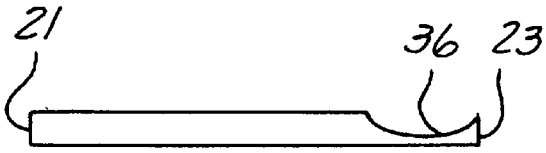
FIG. 4B is a sectional view of a second embodiment of the orthotic shoe sole insert taken along lines 4—4 of FIG. 3.
Figure 4C:
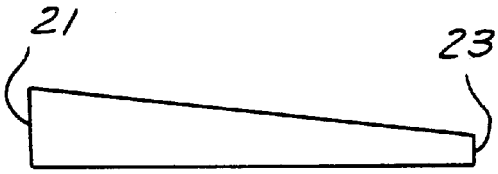
FIG. 4C is a sectional view a third embodiment orthotic shoe sole insert taken along lines 4—4 of FIG. 3.
Figure 6:
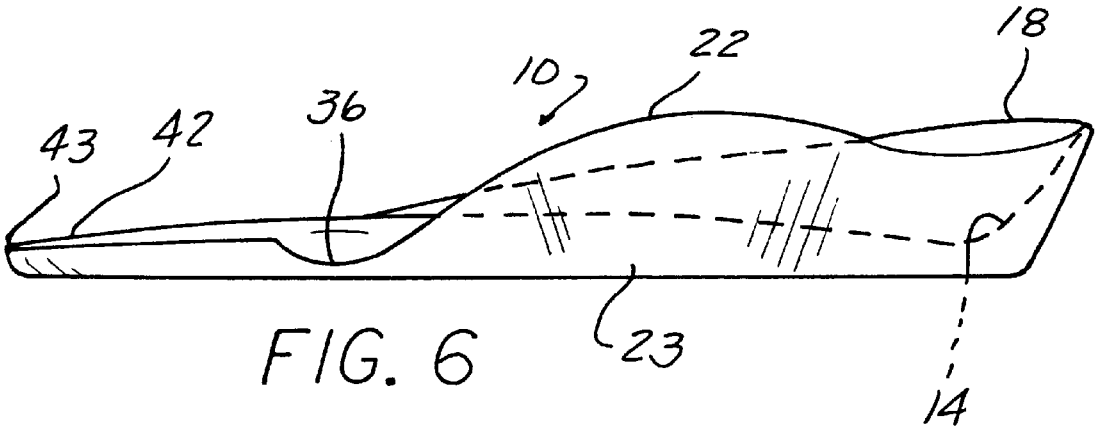
FIG. 6 is a medial side elevational view of the orthotic shoe sole insert of FIG. 3, taken along line 6—6.

Looking especially at FIGS. 4A–C, the elevation of the lateral aspect of the forefoot 26 of the insert is a unique aspect of the invention. There is a valgus wedge 28 that starts at the transverse arch region 30 (shown in FIG. 3) at a mid-foot portion of the insert spaced from the heel and increases in elevation gradually, distally. The transverse arch region 30, as shown in the figures, underlies the transverse arch located at the anterior part of the tarsus and hinder part of the metatarsus of the foot. As can be seen in FIG. 4A, the most prominent point in the elevation is located in the approximate region of the fifth metatarsal head 32*a*, decreasing in elevation near the sulcus region 34 between the toes and the metatarsal heads 32*a, b, c, d, e*. The wedge 28 also decreases proportionately in elevation from the lateral to medial aspect of the device as shown in FIG. 4C. The lateral aspect is shown in FIG. 5 with the lateral edge designated at 21 and the medial aspect is shown in FIG. 6 with the medial edge designated at 23. Due to varying types of the forefoot 26 deformity, the forefoot 26 may be configured to have a valgus wedge 28 thickening laterally, beginning near the lateral first metatarsal head 32*e* and lateral sesamoid area 38. The valgus wedge 28 may vary between 2 and 20° as required. The forefoot 26 could also have a depression 36 formed for receiving the first metatarsal head 32*b*, as shown in FIG. 4A. As an alternative, the correction of the valgus wedge 28 may be neutral under the second metatarsal head 32*d* to the fifth metatarsal head 32*a* with a depression 36 formed for the first metatarsal head 32*e* as shown in FIG. 4B.

The depression 36 is formed at the first metatarsal head 32*e* and sesamoids 38 to accommodate the plantar flexed first ray 40 of the cavus foot. The plantar flexed first metatarsal head 32*e* acts pathologically by striking the ground or shoe first, and preventing the entire foot from pronating. By supporting the surrounding areas of the foot and allowing the first metatarsal head 32*e* and sesamoids 38 to drop below the level of the lateral metatarsal heads 32*a*–32*d*, the insert 10 of the present invention allows the cavus foot to have a more normal biomechanical function.

The distal end 42 from the heel portion 12 has a longer extension 43 ahead of the forefoot portion 26 that will allow for the insert 10 to be trimmed to fit the majority of foot sizes. The sizing for the insert will be discussed hereinafter.

The insert 10 of the present invention is preferably fabricated from ethyl vinyl acetate (EVA). This material is lightweight and durable and has desirable shock absorbing properties. Ethyl vinyl acetate has a relatively low thermal mold temperature (250° F.). This feature of the material provides for the insert to be spot modified with heat as needed. The material has a medium to firm density, (between 40 to 60 durometers) although design variations may include the use of a softer material having less than 25 durometers for vulnerable and potentially high pressure areas such as the heel 12, medial arch 24, first metatarsal head 32*e* and sesamoid areas 38, and head and base of the fifth metatarsal 32*a*. Of course other material, including other soft foam material, may be used to fabricate the insert 10, although the other material may not have all of the benefits of EVA.

Figure 7:
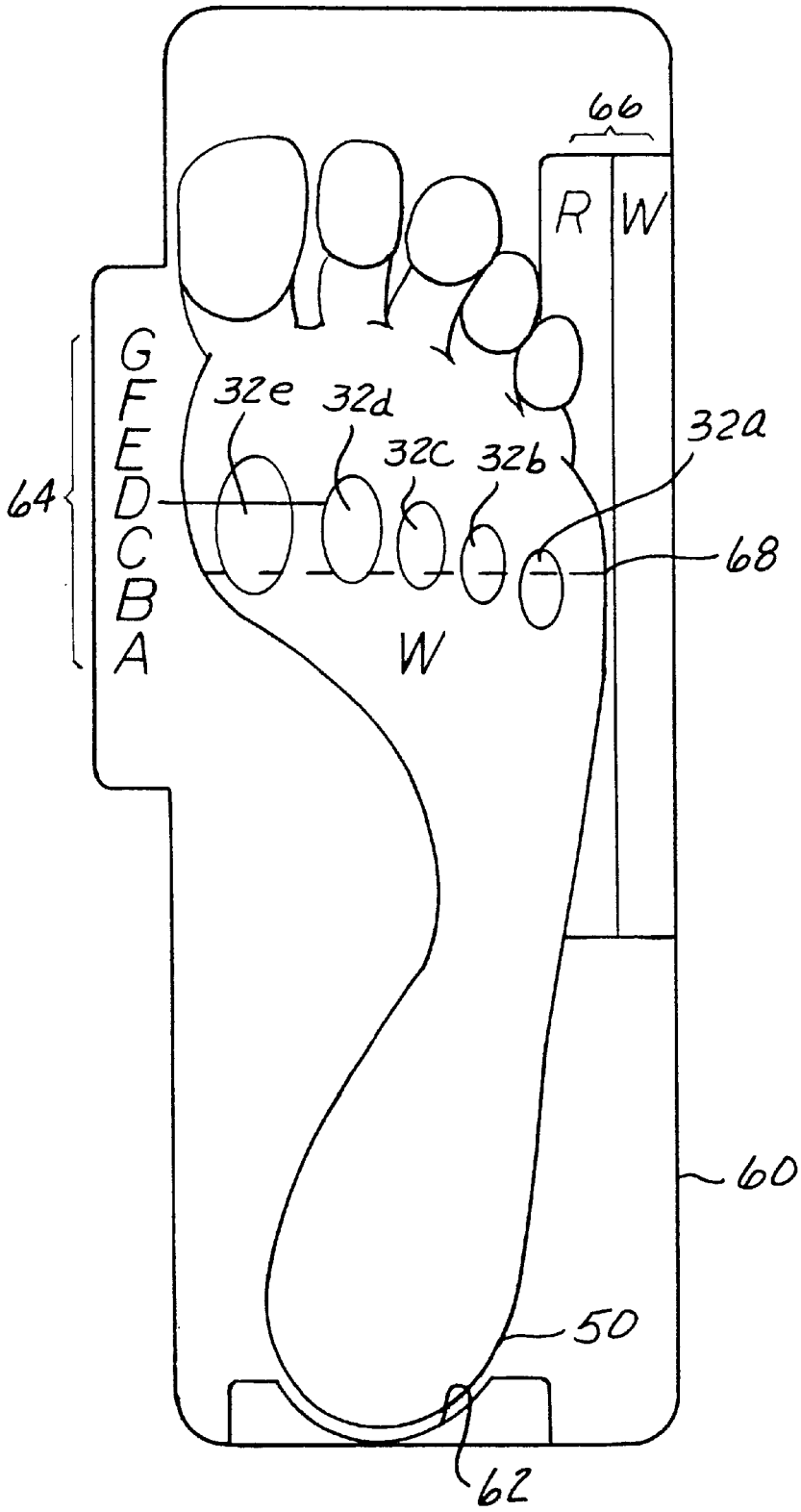
FIG. 7 is a schematic view of a bottom of a foot and a grid ruler for showing the sizing method for an orthotic shoe sole insert as described in the present invention.

To properly size the insert of the present invention a new method for measuring the foot has been devised using a specialized grid as shown in FIG. 7. Current sizing scales measure and fit from the back of the heel to the end of the longest toe. While this method has become standard, it does not address the distance from the heel to the area of the first metatarsal 32*e* which is the arch length. The area of the metatarsal is where the foot flexes and is the widest part of the foot, especially in the cavus foot. Generally the arch length measurement from one patient to another all having the same toe length measurement are not equal and may vary up to 2 whole sizes in some patients. Although the traditional Brannock measuring device has a sliding piece that measures arch length, it is not utilized or even understood by the majority of sales people today.

Measuring for the insert of the present invention will not utilize traditional sizes such as 7 D, 9 B, 10 AA, etc. Sizing for the insert will be a combination of alphabetical symbols based on the arch length with the smallest size starting with A and increasing alphabetically. The insert will be available in two widths, regular and wide which will accommodate most patients. If the need arises for other widths, such as narrow, those will be offered in the future.

Looking at FIG. 7, a schematic of a grid device 60 is shown illustrating a new method for measuring a foot to provide a properly sized insert 10. A right foot 50 is positioned on grid device 60 such that the heel of the foot 50 is placed in a heel insert 62 of the grid device 60. Located approximately midway along the length (L) of grid device 60 is an alphabetic grid 64. The alphabetic grid 64 provides an alphabetic symbol to measure the axial distance between the heel and the first metatarsal head 32*e*. The proper size is chosen by matching the alphabetic symbol (letter) that is closest to the middle of the first metatarsal head 32*e*. In the example shown in FIG. 7 "D" would be the correct length size.

The width measurement is designated by the grid portions 66 designated as R for a regular width and W for a wide width. The grid portions 66 are located adjacent the right edge of the grid device 60 (for a right foot measurement). The grid portion 66 into which the right most portion 68 of the right foot 50 extends on grid device 60 will indicate the width. Grid portion 66 measures the widest span of foot 50 across the medial sesamoid through the fifth metatarsal head 32*a* (as shown by phantom line W). In the example shown in FIG. 7, "R" would be the correct width size. Therefore, using the example and grid 60 shown in FIG. 7, the correct size insert for this foot would be a "D–R". A mirror image of grid device 60 would be available for a left foot measurement.

The insert and improved method for measurement of the same will properly align the foot during movement, alleviate pain by cushioning the foot at its sensitive pressure points, and prevent potential serious injury to the foot and leg by prolonged abnormal foot posture.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An orthotic shoe sole insert for overlying the sole of the shoe of patient having a high arch and adapted for aligning the foot during movement, said insert comprising:

a full length, single piece pad made of a foam material and configured for aligning the foot of the patient having a high arch, said pad having a lateral edge and a medial edge defining side peripheral boundaries of the single piece pad, and an upper surface with a cupped heel base portion and a medial arch area configured for allowing the arch of the foot to pronate without contacting the upper surface of the medial arch area;

said pad having a transverse arch portion transversing the pad from the medial edge to the lateral edge for underlying the transverse arch of the foot located at the anterior part of the tarsus and the hinder part of the metatarsus and having the medial arch area adjacent to the medial edge at the transverse arch portion, said transverse arch portion having a lateral valgus wedge, wherein the upper surface of the transverse arch portion ramps upwardly from the medial edge to the lateral edge;

said pad having a forefoot portion positionable under the metatarsal heads of the foot, wherein the upper surface of said pad upwardly ramps from the forefoot portion to the transverse arch portion and said upper surface of the pad having a lateral heel wedge for underlying the heel to increase the valgus positioning of the heel.

2. The sole insert of claim 1, said pad further having a depression formed in the upper surface of the pad in the forefoot portion adjacent the medial edge for receiving a first metatarsal and the underlying sesamoid of the foot therein.

3. The sole insert of claim 2, said forefoot portion having a neutral wedge for underlying the second metatarsal to the fifth metatarsal.

4. The shoe sole insert of claim 1, wherein said insert is fabricated from ethyl vinyl acetate having a density between 40 to 60 durameters.

5. The sole insert of claim 1, wherein the valgus wedhe varies between 6 o 20°.

6. The shoe sole insert of claim 1, wherein said insert is fabricated from a material having a density less than 25 durometers.

7. The sole insert of claim 1, said forefoot portion having a wedge decreasing proportionately in elevation from the lateral to medial aspect of the pad.

8. The sole insert of claim 1, wherein said pad extending forward of the forefoot portion for trimming to fit a predetermined foot.

9. An orthotic shoe sole insert, said insert comprising:

a full length, single piece pad which is selectively removable and having a lateral edge, a medial edge, a front and rear edge, and an upper surface configured for aligning the foot of a patient having a high arch, wherein said edges define a periphery of the pad;

said upper surface having a cupped heel portion adjacent to the rear edge with a flaring portion to contain the heel pad, to increase resistance to vertical compression of the heel pad, and to improve heel pad shock absorption;

said pad having a transverse arch portion for underlying the transverse arch of the foot located at the anterior part of the tarsus and the hinder part of the metatarsus and a forefoot portion for underlying the metatarsus heads of the foot, and said upper surface having an elevated wedge proximate to the lateral edge at the transverse arch portions and the heel portion wherein the elevated wedge at the transverse arch portion decreases proportionately in elevation toward the medial edge.

10. The sole insert of claim 9, wherein the heel portion is elevated relative to the forefoot portion.

11. The sole insert of claim 9, wherein the forefoot portion has a depression adjacent the medial edge for receiving the first metatarsal head of the foot and the forefoot has a flat portion underlying the second to fifth metatarsal head.

12. The sole insert of claim 9, wherein the pad has an extension ahead of the forefoot portion adapted for trimming.

13. The sole insert of claim 9, wherein the pad is made from an ethyl vinyl acetate material.

14. An orthotic shoe sole insert for overlaying sole of the shoe of a person having a high arch, said insert comprising:

a full length, single piece pad made of shock absorbing material having a lateral edge and a medial edge defining side peripheral boundaries of the single piece pad, and an upper surface configured for aligning the foot during movement of a person having a high arch, said upper surface including a slightly elevated cupped heel portion with a flaring portion to contain the fibrous heel pad of the foot, to increase resistance to vertical compression of the heel pad and to improve heel pad shock absorption;

said pad having a transverse arch region for underlying the transverse arch of the foot located at the anterior part of the tarsus and the hinder part of the metatarsus, and a medial arch portion adjacent the medial edge of the transverse arch region;

said pad having a forefoot portion at an opposing end from the heel portion, said forefoot portion positionable under the metatarsal heads of the foot;

said upper surface of the pad forming a lateral valgus wedge at the transverse arch region, the forefoot portion, and the heel portion, wherein said lateral valgus wedge at the forefoot portion, the transverse arch region and the heel portion forms a raised section adjacent the lateral edge of the upper surface of the pad which is higher tan a section of the upper surface along the medial edge at the forefoot portion, the transverse arch portion and the heel portion respectively.

15. The insert of claim 14, wherein a depression is formed in the upper surface of the pad in the forefoot portion adjacent the medial edge for receiving a first metatarsal and the underlying sesamoid of the foot therein.

16. The insert of claim 14, wherein the valgus wedge in the forefoot portion is neutral at a portion positionable under the second metatarsal head to the fifth metatarsal head, said upper surface forming a depression positionable under the first metatarsal head and said upper surface forming a recessed area positionable under the medial arch portion, said recessed area configured to allow the arch of the foot to pronate without coming into contact with the upper surface of the medial arch portion.

17. The insert of claim 14, wherein the upper surface of the medial arch portion is recessed to allow the arch of the foot to promote without coming into contact with the upper surface of the medial arch.

* * * * *